US007380482B1

(12) United States Patent
Chan

(10) Patent No.: US 7,380,482 B1
(45) Date of Patent: Jun. 3, 2008

(54) HIGH-STRENGTH RATCHET STRUCTURE FOR RATCHET WRENCH

(76) Inventor: Fu-Yi Chan, No. 24, Alley 9, Lane 82, Yitung Rd., Taiping City, Taichung County (TW)

( * ) Notice: Subject to any disclaimer, the term of this patent is extended or adjusted under 35 U.S.C. 154(b) by 0 days.

(21) Appl. No.: 11/714,173

(22) Filed: Mar. 6, 2007

(51) Int. Cl.
*B25B 13/46* (2006.01)
*B25B 23/16* (2006.01)

(52) U.S. Cl. ..... 81/63.1; 192/43.2; 81/177.7

(58) Field of Classification Search ..... 81/62, 81/63.1, 63.2, 177.85, 177.7; 192/43.2
See application file for complete search history.

(56) References Cited

U.S. PATENT DOCUMENTS 6,047,802 A * 4/2000 Huang ..... 192/43.2
7,237,459 B1 * 7/2007 Shiao ..... 81/62
2006/0096422 A1 * 5/2006 Huang ..... 81/63.1
2007/0044594 A1 * 3/2007 Chen ..... 81/63.1
2007/0240544 A1 * 10/2007 Hu ..... 81/63.1

* cited by examiner

*Primary Examiner*—D. S Meislin
(74) *Attorney, Agent, or Firm*—Rosenberg, Klein & Lee

(57) ABSTRACT

A high-strength ratchet structure for ratchet wrench is disclosed to include a driving block with two transverse sliding grooves, two pairs of directional block members respectively movably mounted in the sliding grooves of the driving block, two spring members respectively mounted in the sliding grooves and supported between the associating directional block members, a ratchet member coupled to the driving block, and a direction control ring selectively set in a first position where the ratchet member is locked to the driving block, a second position where the ratchet member is prohibited from clockwise rotation relative to the driving block and allowed for counter-clockwise rotation relative to the driving block, or a third position where the ratchet member is prohibited from counter-clockwise rotation relative to the driving block and allowed for clockwise rotation relative to the driving block.

3 Claims, 6 Drawing Sheets

HIGH-STRENGTH RATCHET STRUCTURE FOR RATCHET WRENCH

BACKGROUND OF THE INVENTION

1. Field of the Invention

The present invention relates to ratchet wrench and more specifically, to a high-strength ratchet structure for ratchet wrench.

2. Description of the Related Art

Many reversible ratchet wrenches are commercially available. These reversible ratchet wrenches commonly comprise a wrench body, a ratchet member coupled to the wrench body, a directional block member for engaging the ratchet member to control the direction of rotation of the ratchet member relative to the wrench body, prohibiting the ratchet member from clockwise rotation and allowing the ratchet member for counter-clockwise rotation, or prohibiting the ratchet member from counter-clockwise rotation and allowing the ratchet member for clockwise rotation. This single-sided stop control design is not applicable for high torque application. The ratchet member may slip when encountering a high resistance, resulting in a failure.

SUMMARY OF THE INVENTION

The present invention has been accomplished under the circumstances in view. It is the main object of the present invention to provide a high-strength ratchet structure for ratchet wrench, which is practical for high torque application. According to the present invention, the high-strength ratchet structure comprises a driving block, the driving block having a stepped axial hole cut through front and rear sides thereof, and two sliding grooves transversely formed on the front side and arranged in parallel at two sides of the stepped axial hole; two pairs of directional block members respectively movably mounted in the sliding grooves of the driving block; two spring members respectively mounted in the sliding grooves of the driving block and respectively supported between the associating directional block members; a ratchet member coupled to the driving block, the ratchet member having an axial screw hole and a plurality of teeth arranged around the inside wall thereof; a hollow screw bolt mounted in the stepped axial hole of the driving block and threaded into the axial screw hole of the ratchet member to secure the ratchet member to the driving block; and a direction control ring mounted on the driving block around the directional block members and rotatable relative to the driving block to control engagement between the directional block members and the teeth of the ratchet member, the directional control ring having a plurality of protruding portions and recessed portions alternatively arranged around an inner diameter thereof for selectively acting against the directional block members to control engagement between the directional block members and the teeth of the ratchet member. The direction control ring can selectively set in a first position where the ratchet member is locked to the driving block and prohibited from rotation relative to the driving block, a second position where the ratchet member is prohibited from clockwise rotation relative to the driving block and allowed for counter-clockwise rotation relative to the driving block, or a third position where the ratchet member is prohibited from counter-clockwise rotation relative to the driving block and allowed for clockwise rotation relative to the driving block.

DETAILED DESCRIPTION OF THE PREFERRED EMBODIMENT

Figure 1:
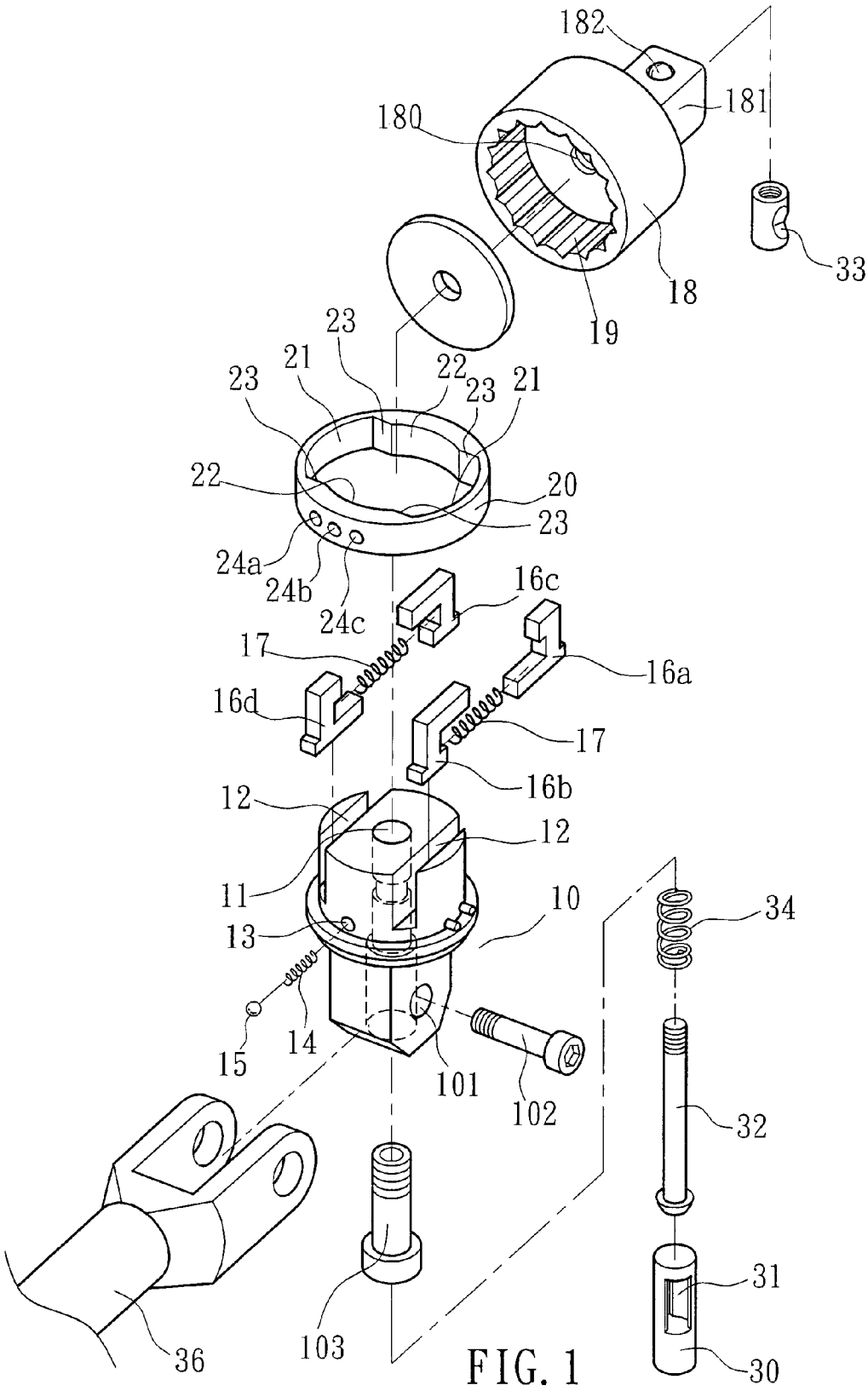
FIG. 1 is an exploded view of a high-strength ratchet structure for ratchet wrench in accordance with the present invention.

Referring to FIGS. 1~7, a high-strength ratchet structure for ratchet wrench in accordance with the present invention is shown comprising a driving block 10. The driving block 10 has a stepped axial hole 11 cut through the top and bottom sides thereof, a pivot hole 101 transversely extending through its one end across the stepped axial hole 11 and pivotally connected to a swivel rod 36 with a pivot bolt 102, two sliding grooves 12 transversely arranged on its other end at two sides of the stepped axial hole 11, a side blind hole 13 extending in direction perpendicular to the extending direction of the stepped axial hole 11 and equally spaced from the sliding grooves 12 for accommodating a spring member 14 and a steel ball 15. The steel ball 15 is supported on one end of the spring member 14 and partially protruding over the periphery of the driving block 10. Two directional block members 16*a* and 16*b*, or 16*c* and 16*d* are respectively slidably mounted in the sliding grooves 12 of the driving block 10. A spring member 17 is supported between the two directional block members 16*a* and 16*b*, or 16*c* and 16*d* in each sliding groove 12.

A direction control ring 20 is sleeved onto the driving block 10 and supported on a part (collar) of the driving block 10 corresponding to the elevation of the side blind hole 13, having recessed portions 21 and protruding portions 22 alternatively arranged around the inner diameter, a stop wall 23 between each recessed portion 21 and each adjacent protruding portion 22, and three transversely extending locating holes 24*a*, 24*b* and 24*c* selectively for receiving the steel ball 15.

A ratchet member 18 is coupled to the driving block 10 and supported on the direction control ring 20. The ratchet member 18 has teeth 19 arranged around the inside wall, an axial screw hole 180, a hollow rectangular coupling rod 181 extending from its front side in axial alignment with the axial screw hole 180 for securing a socket 37 for turning a bolt or not, and a steel ball 182 mounted in a transverse side hole of the hollow rectangular coupling rod 181 and movable in and out of the hollow rectangular coupling rod 181 to lock/unlock the socket 37. A hollow screw bolt 103 is mounted into the stepped axial hole 11 and threaded into the axial screw hole 180 to secure the ratchet member 18 to the driving block 10. A control bolt 32 is inserted through the hollow screw bolt 103 and screwed up with a notched nut 33. A spring member 34 is sleeved onto the control bolt 32 and supported between one end (the head) of the control bolt 32 and one end (the head) of the hollow screw bolt 103. A control block 30 is inserted into one end of the stepped axial hole 11 of the driving block 10, having a longitudinal sliding slot 31 coupled to the pivot bolt 102.

Figure 2A:
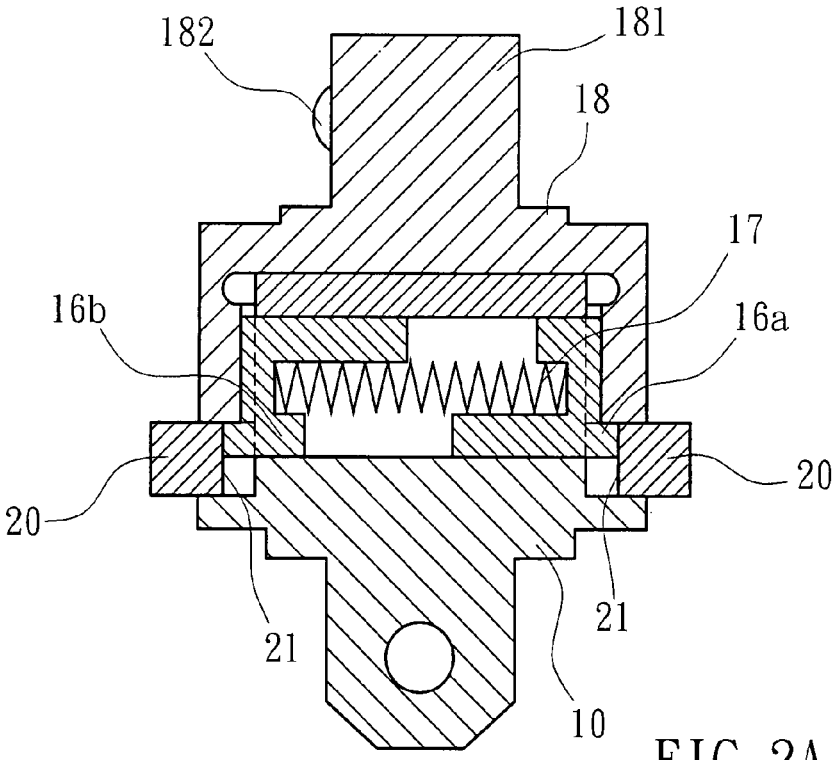
FIG. 2A is a sectional front view of the present invention, showing the direction control ring of the high-strength ratchet structure rotated to the middle position.
Figure 2B:
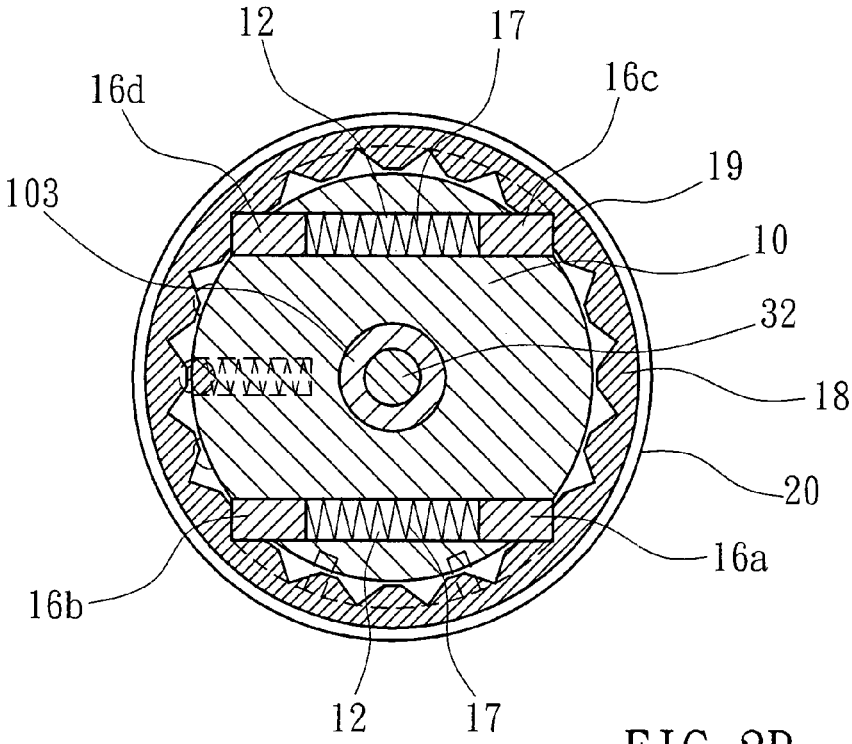
FIG. 2B is a sectional top view of the present invention, showing the direction control ring of the high-strength ratchet structure rotated to the middle position.
Figure 3A:
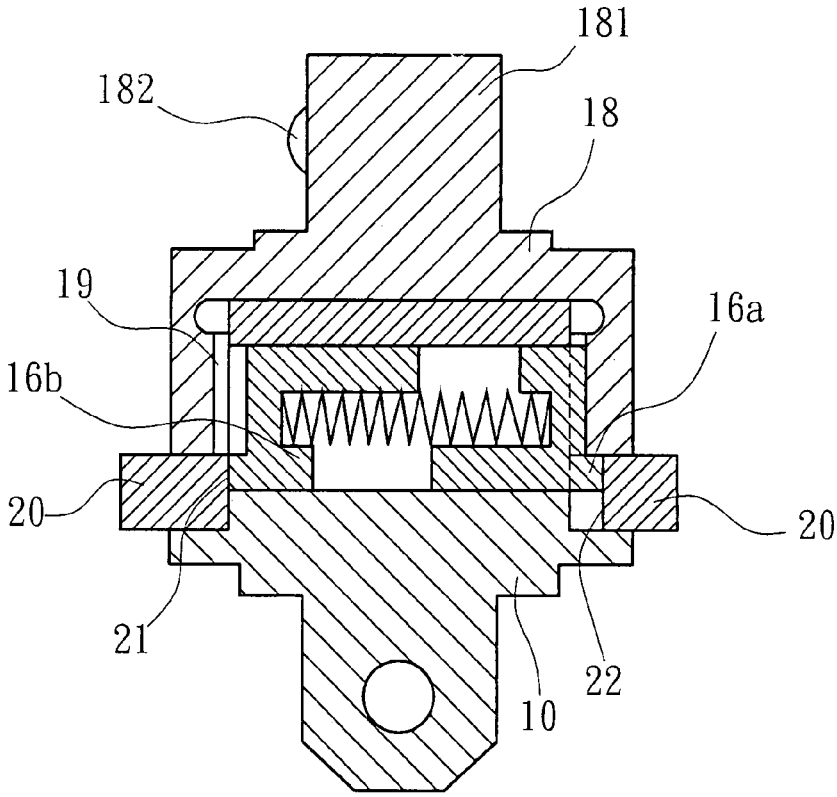
FIG. 3A is a sectional front view of the present invention, showing the direction control ring of the high-strength ratchet structure rotated to the left position.
Figure 3B:
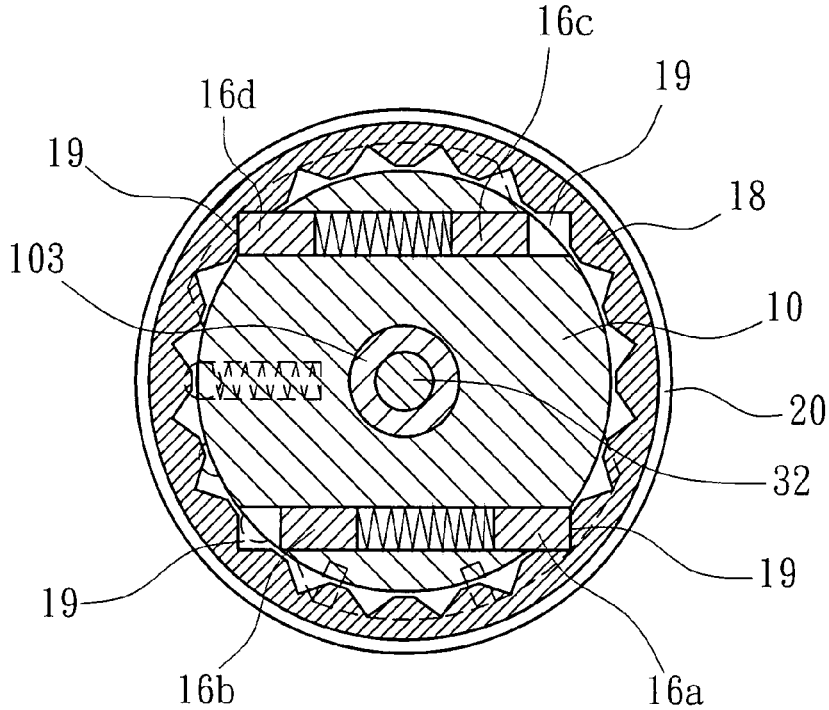
FIG. 3B is a sectional top view of the present invention, showing the direction control ring of the high-strength ratchet structure rotated to the left position.
Figure 4A:
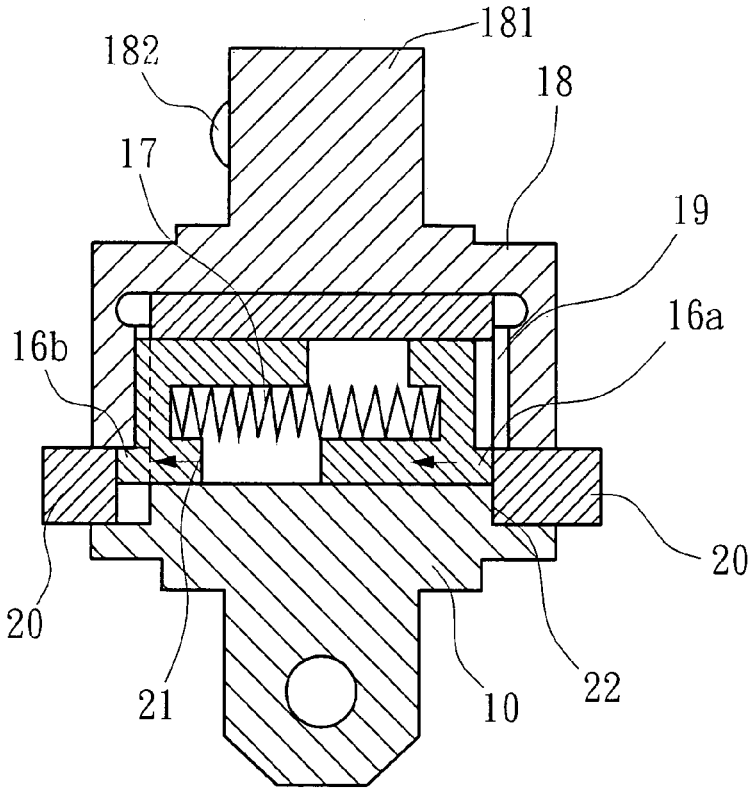
FIG. 4A is a sectional front view of the present invention, showing the direction control ring of the high-strength ratchet structure rotated to the right position.
Figure 4B:
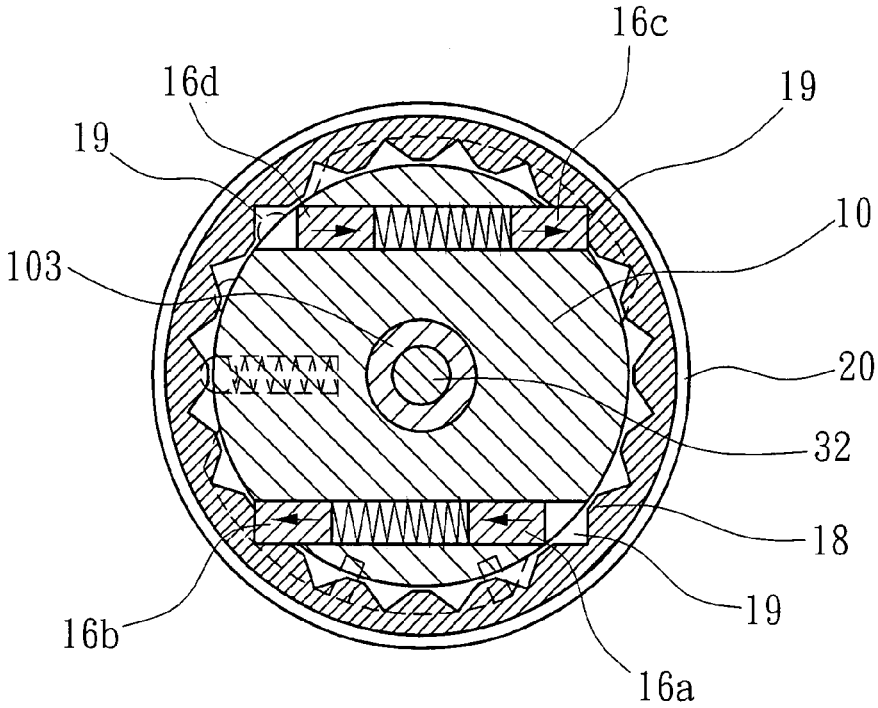
FIG. 4B is a sectional top view of the present invention, showing the direction control ring of the high-strength ratchet structure rotated to the right position.

The direction control ring 20 of the high-strength ratchet wrench can be selectively set in the position shown in FIGS. 2A and 2B where the ratchet member 18 is locked to the driving block 10 and prohibited from rotation relative to the driving block 10, the position shown in FIGS. 3A and 3B where the ratchet member 18 is prohibited from clockwise rotation relative to the driving block 10 and allowed for counter-clockwise rotation relative to the driving block 10, or the position shown in FIGS. 4A and 4B where the ratchet member 18 is prohibited from counter-clockwise rotation relative to the driving block 10 and allowed for clockwise rotation relative to the driving block 10.

When the direction control ring 20 of the high-strength ratchet wrench is rotated to the middle position, i.e., the position shown in FIGS. 2A and 2B, the steel ball 15 of the driving block 10 is engaged into the intermediate locating hole 24*b*, and the four directional block members 16*a*~16*d* are respectively stopped against the respective stop walls 23 of the direction control ring 20 and held in engagement with the teeth 19, and therefore the ratchet member 18 is locked to the driving block 10 and prohibited from rotation relative to the driving block 10.

When the direction control ring 20 of the high-strength ratchet wrench is rotated to the left position, i.e., the position shown in FIGS. 3A and 3B, the steel ball 15 of the driving block 10 is engaged into the left locating hole 24*a*, the two directional block members 16*a* and 16*d* are respectively stopped against the respective stop walls 23 of the direction control ring 20 and held in engagement with the teeth 19, and the other two directional block members 16*b* and 16*c* are respectively stopped against the protruding portions 22 and disengaged from the teeth 19, and therefore the ratchet member 18 is prohibited from clockwise rotation relative to the driving block 10 and allowed for counter-clockwise rotation relative to the driving block 10.

When the direction control ring 20 of the high-strength ratchet wrench is rotated to the right position, i.e., the position shown in FIGS. 4A and 4B, the steel ball 15 of the driving block 10 is engaged into the right locating hole 24*c*, the two directional block members 16*c* and 16*b* are respectively stopped against the respective stop walls 23 of the direction control ring 20 and held in engagement with the teeth 19, and the other two directional block members 16*a* and 16*d* are respectively stopped against the protruding portions 22 and disengaged from the teeth 19, and therefore the ratchet member 18 is prohibited from counter-clockwise rotation relative to the driving block 10 and allowed for clockwise rotation relative to the driving block 10.

Figure 5:
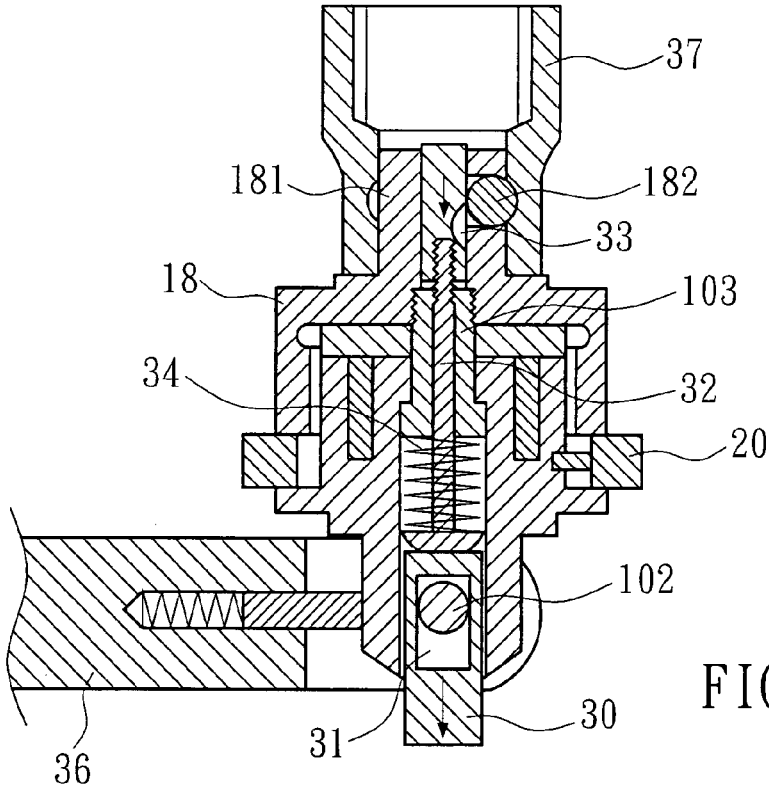
FIG. 5 is a sectional view of the present invention, showing a socket locked to the driving block of the high-strength ratchet structure.

Referring to FIG. 5, when a socket 37 is attached to the hollow rectangular coupling rod 181 of the ratchet member 18, the spring member 34 pushes the control bolt 32 away from the hollow screw bolt 103, keeping the smooth peripheral wall of the notched nut 33 is contact with the steel ball 182, and therefore the steel ball 182 is forced out of the hollow rectangular coupling rod 181 into engagement with an inside annular groove of the socket 37 to lock the socket 37 to the hollow rectangular coupling rod 181.

Figure 6:
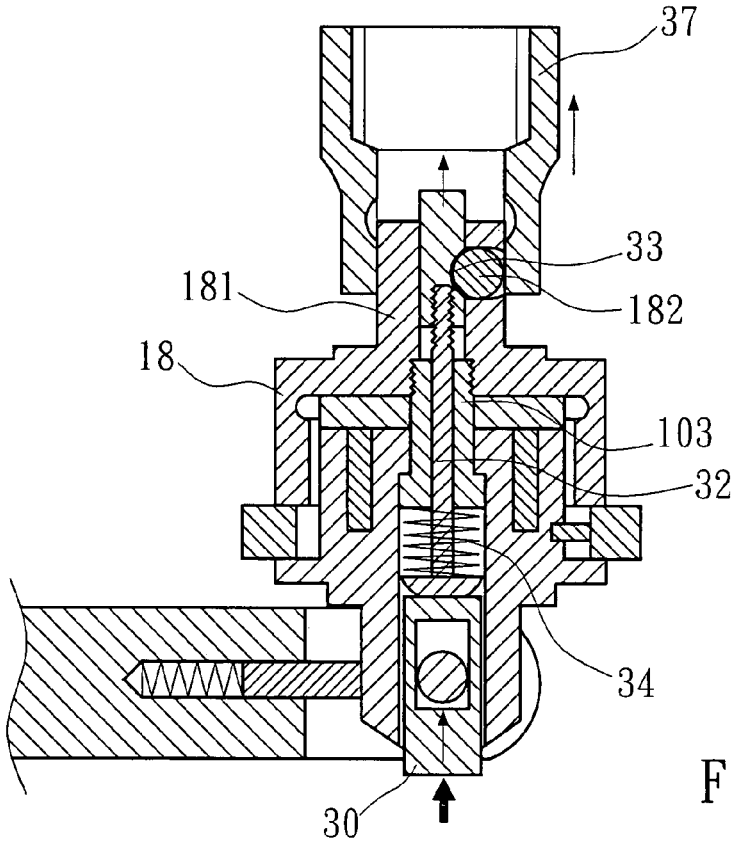
FIG. 6 corresponds to FIG. 5, showing the steel ball disengaged from the socket.
Figure 7:
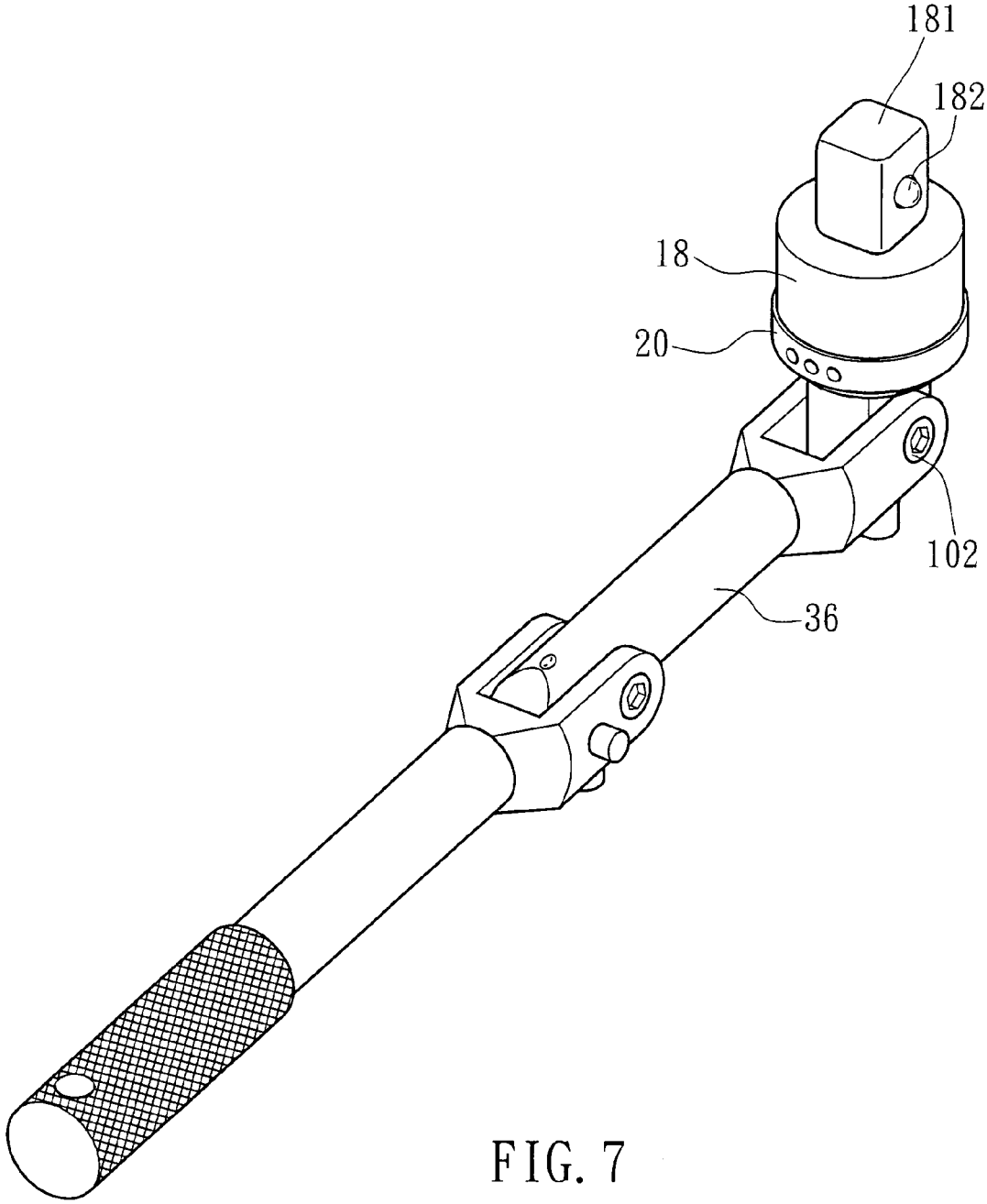
FIG. 7 is an elevational view of the high-strength ratchet wrench embodying the present invention.

Referring to FIG. 6, when pushing the control block 30 against the control bolt 32, the notched nut 33 is moved relative to the steel ball 182 to aim the peripheral notch of the notched nut 33 at the steel ball 182, therefore the steel ball 182 is received inside the hollow rectangular coupling rod 181 to unlock the socket 37, allowing removal of the socket 37 from the rectangular coupling rod 181.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A high-strength ratchet structure comprising:

a driving block, said driving block having a stepped axial hole cut through front and rear sides thereof, and two sliding grooves transversely formed on the front side and arranged in parallel at two sides of said stepped axial hole;

two pairs of directional block members respectively movably mounted in said sliding grooves of said driving block;

two spring members respectively mounted in said sliding grooves of said driving block and respectively supported between the associating directional block members;

a ratchet member coupled to said driving block, said ratchet member having an axial screw hole, a plurality of teeth arranged around the inside wall thereof, and a rectangular coupling rod for securing a socket for turning bolts and nuts;

a hollow screw bolt mounted in said stepped axial hole of said driving block and threaded into the axial screw hole of said ratchet member to secure said ratchet member to said driving block; and a direction control ring mounted on said driving block around said directional block members and rotatable relative to said driving block to control engagement between said directional block members and the teeth of said ratchet member, said directional control ring having a plurality of protruding portions and recessed portions alternatively arranged around an inner diameter thereof for selectively acting against said directional block members to control engagement between said directional block members and the teeth of said ratchet member.

2. The high-strength ratchet structure as claimed in claim 1, wherein said directional control ring has three locating holes; said driving block has a spring member mounted in a side blind hole thereof and a steel ball supported on the spring member in said side blind hole and adapted to engage one of the three locating holes to secure said directional control ring to said driving block in one of three control positions.

3. The high-strength ratchet structure as claimed in claim 1, further comprising a control bolt inserted through said hollow screw bolt, a spring member sleeved onto said control bolt and supported between one end said control bolt and one end of said hollow screw bolt, a control block fastened one end of said stepped axial hole of said driving block by a slip joint, a steel ball mounted in a transverse hole on said rectangular coupling rod of said ratchet member and movable out of said rectangular coupling rod partially for locking a socket to said rectangular coupling rod, and a notched nut suspending inside said rectangular coupling rod of said ratchet member and fastened to said control bolt and movable with said control bolt relative to said ratchet member to move the steel ball in and out of the transverse hole on said rectangular coupling rod of said ratchet member.

* * * * *